United States Patent [19]

Hegemann

[11] Patent Number: 4,766,630

[45] Date of Patent: Aug. 30, 1988

[54] TWIN-BRUSHES ROTARY TOOTHBRUSH

[76] Inventor: Kenneth J. Hegemann, 930 East Grove St., West Point, Nebr. 68788

[21] Appl. No.: 48,086

[22] Filed: May 11, 1987

[51] Int. Cl.[4] ..... A46B 13/08

[52] U.S. Cl. ..... 15/22 R; 15/28

[58] Field of Search ..... 15/22 R, 22 C, 28, 29, 15/25, 26; 128/62 R

[56] References Cited

U.S. PATENT DOCUMENTS 4,048,690 9/1977 Wolfson ..... 15/22 R

*Primary Examiner*—Edward L. Roberts

*Attorney, Agent, or Firm*—George R. Nimmer

[57] ABSTRACT

Rotary toothbrush utilizes a longitudinally extending hollow barrel having a fore-end and a rear-end. Longitudinally extending and reciprocatable strokearm mechanism is predominately located within the hollow barrel but includes a forward-portion always located forwardly of the barrel. A pair of transversely separated, upright rotary brushes are positioned wholly forwardly of the barrel and there eccentrically journal crankshafts carried by the strokearm mechanism forward-portion so that strokearm reciprocations cause the two brushes to move together in alternating angular directions. The strokearm mechanism forward-portion might be provided with auxiliary bristles for simultaneously brushing the dental occlusial surfaces as the rotary brushes treat the bucal and lingual surfaces.

16 Claims, 2 Drawing Sheets

TWIN-BRUSHES ROTARY TOOTHBRUSH

BACKGROUND OF THE INVENTION

As evidenced by representative U.S. Pat. No. 4,048,690 (Wolfson—9/20/1977), the prior art recognizes that previously unattainable dental cleaning benefits are attainable with "twinbrushes rotary toothbrushes" wherein the twin-brushes angular reciprocate in unison. During each co-angular reciprocation of the twinbrushes, the following gingival area cleaning simultaneosuly occurs at the bucal and lingual teeth sides: at the first angular movement, inimical plaque is abradably removed; and at the second angular movement, said removed plague particles are swept directionally away from the sensitive gingival sulcus. Moreover, another heretofore unattainable cleansing simultaneously occurs to the bucal and lingual sides during each co-angular reciprocation of the twin-brushes, namely the vertically extending inter-proxial juncture areas of adjacent teeth are cleansed directionally away from the sensitive gingival sulcus.

Although U.S. Pat. No. 4,048,690 describes "twin-brushes rotary toothbrushes" that have theoretically solved the aforementioned dental cleaning problems, it teaches a bulky and structural mounting and actuation for the twin-brushes and to the extent that a so constructed twin-brushes rotary toothbrush is too large to fit and operationally function within the mouth of persons anatomically endowed with average or small size mandible.

And although U.S. Pat. No. 4,048,690 does teach usage of auxilary bristles (and located between the twin-brushes) for simultaneously cleaning teeth occlusial surfaces, it is difficult for the operator to simultaneously reciprocate the auxiliary occlusial brushes and the bucal/lingual twin-brushes.

GENERAL OBJECTIVE OF THE INVENTION

It is accordingly the general objective of the present invention to provide a twin-brushes rotary toothbrush concept that represents marked improvement over those of the prior art. It is an ancillary general objective to provide a twin-brushes rotary toothbrush that is unusually compact and to such extent that it will readily fit and operationally function within the mandible anatomy of most male and female persons, that reliably performs substantially all required dental cleansing tasks, and that is easy for the operator to simultaneously perform required occlusial, bucal, and lingual cleansing tasks.

GENERAL STATEMENT OF THE INVENTION

With the above general objectives in view, and together with other related and specific objectives which will become more apparent as this description proceeds, the twin-brushes rotary toothbrush concept of the present invention generally comprises: a directionally longitudinally extending hollow barrel having a fore-end and a rear-end; longitudinally extending and longitudinally reciprocatable strokearm means located predominately within and connected to the barrel, the strokearm means having a forward-portion that is always located forwardly of the barrel; and a pair of transversely separated upright rotary brushes located forwardly of the barrel and flanking the strokearm means forward-portion, the strokearm means forward-portion carrying transversely extending crankshafts bearing against slotted portions of the brushes whereby, as the strokearm means longitudinally reciprocates, the twin-brushes are caused to move together and in alternating angular directions.

BRIEF DESCRIPTION OF THE DRAWING

In the drawing, wherein like characters refer to like parts in the several views, and in which.

DETAILED DESCRIPTION OF THE DRAWING

Figure 1:
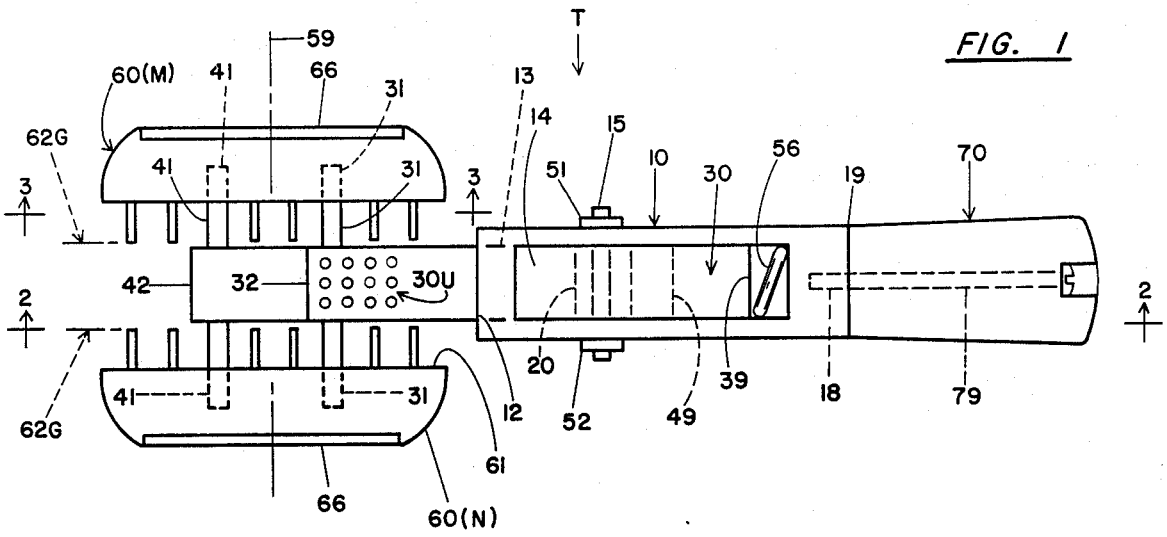
FIG. 1 is a top plan view of a representative embodiment "T" of the twin-brushes rotary toothbrush concept of the present invention.

Turning initially to drawing FIGS. 1–4 which depict a representative embodiment "T" of the twin-brushes rotary toothbrush concept of the present invention. Embodiment "T" generally comprises: a horizontally and directionally longitudinally extending barrel 10 having an upright fore-end 12, an upright rear-end 19, and horizontally longitudinally extending topside 10A and bottomside 10B; as an angularly reciprocatable coordinator, a pinion 20 co-revolvably surrounding a barrel-pivot (e.g. pin 15) that directionally transversely intersects barrel 10; as a reciprocatable strokearm means, a pair of substantially parallel, longitudinally extending, and vertically offset strokearms 30 and 40, the strokearms forward-portions (32, 42) always being located forwardly beyond barrel fore-end 12 and the strokearms rack-teeth rearward-portions (37, 47) being within the barrel and there engaged with vertically opposite sides of pinion 20 whereby the strokearms might longitudinally reciprocate and respectively in opposite longitudinal directions; a pair of transversely separated upright rotary brushes 60(M) and 60(N) positioned wholly forwardly of barrel fore-end 12 and being respectively actuatably associated with strokearm crankshafts (31, 41) whereby the brushes move together in angular reciprocation as the strokearms longitudinally reciprocate; and together with ancillary features such as powering means (e.g. 50), a manually graspable handle (e.g. 70), etc.

Barrel 10 at its fore-end 12 is centrally open (13) to permit passage therethrough of the strokearm means (e.g. 35, 45) and which means is predominately located within the barrel hollow interior (14). Between barrel ends 12 and 19, there is a horizontal and directionally transversely extending barrel-pivot such as a barrel-pin 15 and is rotatably secured to the barrel longitudinally extending upright sides.

Figure 2:
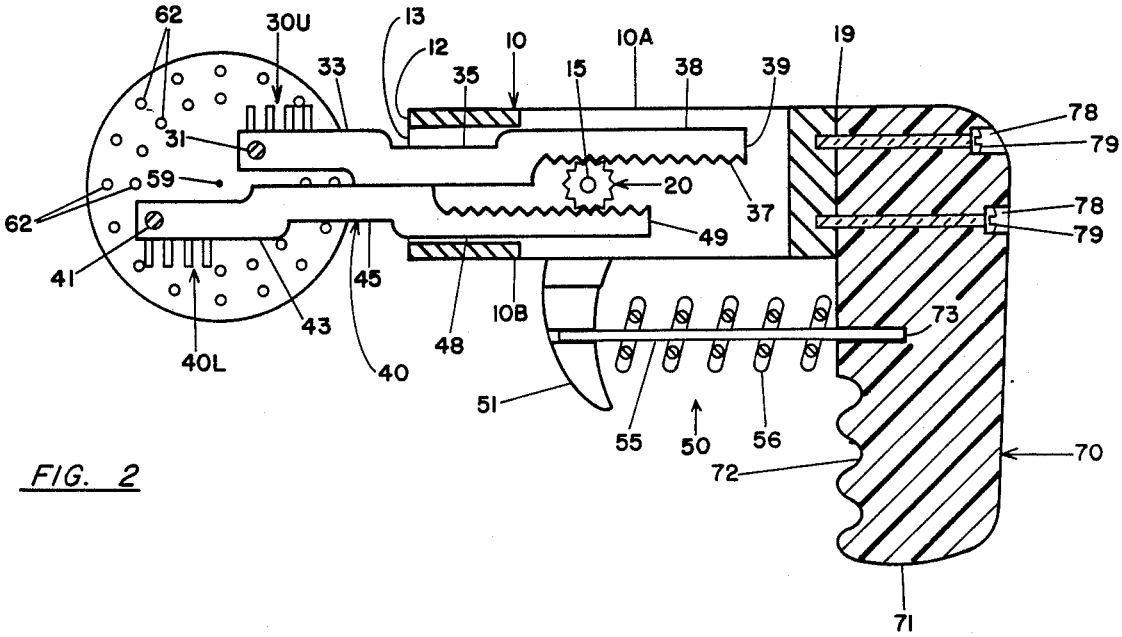
FIG. 2 is a longitudinally extending sectional elevational view of embodiment "T" and taken along line 2—2 of FIG. 1.
Figure 2A:
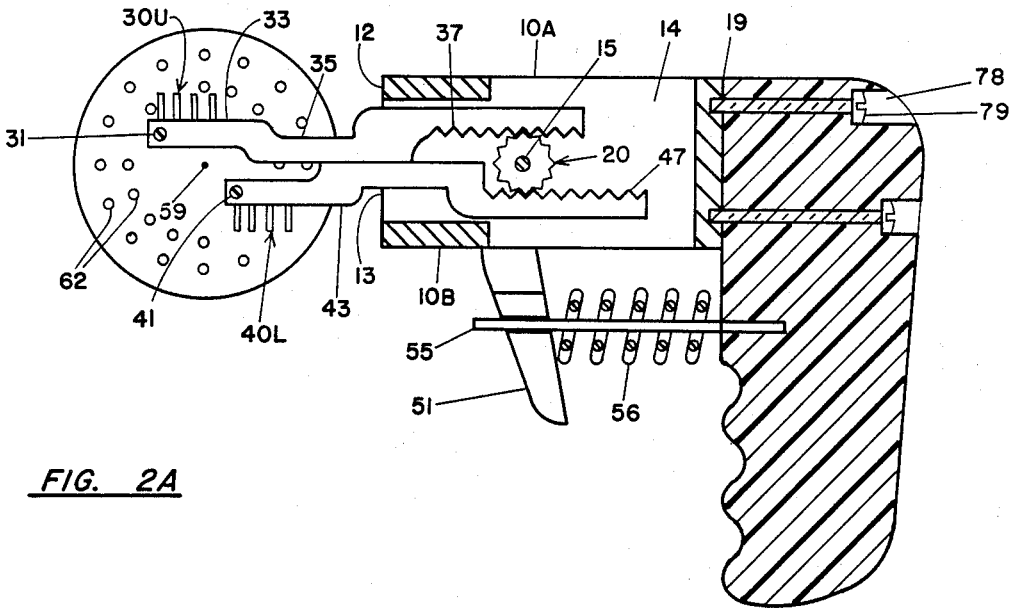
FIG. 2A is a sectional elevational view related to FIG. 2 and showing that a powering means has caused a strokearm means to longitudinally reciprocate.

A contra-directional coordinator (e.g. 20, 25) is locatable within barrel 10. For example, as seen in FIGS. 2 and 2A, a said coordinator ensures that two strokearms (35, 45) simultaneously longitudinally reciprocate, and respectively in opposite longitudinal directions. In embodiment "T", the contra-directional coordinator comprises a pinion 20 that co-revolvably surrounds barrel-pin 15.

Upper strokearm 35 has a medial-portion 33 that is longitudinally slidably disposed along the medial-portion 43 of the lower-strokearm 45. Upper-strokearm 35 has a longitudinally extending rack-teeth rearward-portion 37 overlying and enmeshed with pinion 20. Similarly, lower-strokearm 45 has a longitudinally extending rack-teeth rearward-portion 47 underlying and enmeshed with pinion 20. Forwardly beyond barrel fore-end 12, the upper strokearm forward-portion carries a pair of transversely extending and transversely aligned crankshafts 31. Similarly, the lower-strokearm forward-portion carries a pair of transversely extending and transversely aligned crankshafts 41. Inasmuch as the strokearms 30 and 40 are longitudinally slidably engaged (e.g. at 33, 43): crankshafts 31 remain at constant elevation as upper-strokearm 35 longitudinally reciprocates; and crankshafts 41 remain at a constant elevation (though below crankshafts 31) as lower-strokearm 45 longitudinally reciprocates. The upper-strokearm forward-portion can be provided with an upwardly extending bristles array 30U; and similarly, the lower-strokearm forward-portion can be provided with a downwardly extending bristles array 40L.

Transversely separated and upright brushes 60(M) and 60(N), which circularly surround a common transverse-axis 59, respectively include an array of bristles 62 extending transversely toward the strokearm means to terminate at bristles upright-planes 62G. Radially above transverse-axis 59, the leadward-side upright 61 of each brush is provided with an elliptically upper slotted portion 63 for journalling crankshafts 31. Analagously, but radially below transverse-axis 59, the leadward-side 61 of each brush is provided with an elliptically lower slotted portion 64 for journalling crankshafts 41. Accordingly, as stroke-arms 30 and 40 reciprocate in opposite longitudinal directions, the crankshafts 31 and 41 bear longitudinally against the brushes whereby the brushes move together and in synchronization with the angular reciprocation of the contra-directional coordinator (20, 25).

Figure 6:
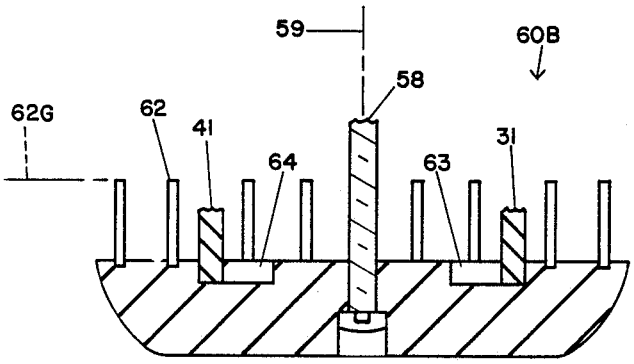
FIG. 6 is a sectional view related to that of FIG. 4.

There are means for maintaining a fixed transverse spacing between brushes 60(M) and 60(N). For example, as alluded to in FIG. 6, one such means might take the form of an axle member 58 extending along transverse-axis 59 and affirmatively connecting the two brushes with an axle. And as suggested by FIG. 4, an alternate such means entails affirmatively attaching the crankshafts 31 and 41 to the brushes, such as with fastener grommets (31K, 41K). In the latter regard, the trailward-side of each brush is recessed (65) to communicate with the leadward-side slots (63, 64) to accommodate the grommet fasteners (31K, 41K) for crankshafts 31 and 41, respectively. The brush trailward-side is then provided with a smoothly contoured removable cap 66 that is frictionally engaged within said recess 65. However, both such means (i.e. axle 58 and fasteners 31K, 41K) might be simultaneously employed for enhancing the toothbrush durability.

The aforementioned elements (10, 20, 35, 45, 60(M), 60(N)) represent a self-sustaining structure that might be removably attached to an upright and manually graspable handle member (e.g. 70). For example, horizontal screws 79 extending through handle apertures 79 might threadedly engage barrel rear-wall 19. Herein, and immediately above its lower-end 71, handle member 70 is optionally provided with a handle-grip frontal contour 72.

Apt powering means might be employed for longitudinally reciprocating the strokearm means so that the two brushes are caused to co-movably angularly reciprocate about common transverse-axis 59. In the case of dual-strokearms (e.g. 35, 45), such powering means might be directly connected to one or both strokearms, or alternatively, to the contra-directional coordinator. For embodiments "T" and "TA", the powering means 50 comprises a finger actuatable trigger 51 flanking barrel 10 and affirmatively attached to barrel-pin 15. The trigger 51 extends below barrel bottomside 10B, and hence, locatable forwardly of handle member 70. A helical spring 56, herein surrounding a rod extension 73 of handle 70, is interposed between trigger 51 and handle 70 whereby spring 56 tends to maintain the strokearms positions of FIG. 2. However, whenever trigger 51 is resiliently depressed toward handle 70, the strokearms assume the positions depicted in FIG. 2A. Thus, for each depression and release of trigger 51, the reciprocating strokearm bristles 30U and 40L brush the dental occlusial surfaces while the brush bristles 62 simultaneously efficaceously sweep the dental bucal and lingual surfaces.

As previously mentioned, powering means for the strokearm means might be other than the trigger style and other than power directly applied to a dual-directional coordinator (e.g. 20, 25). For example, hydraulic, pneumatic, and cordless-rechargeable electric cable type powering means might be made to act directly upon the strokearm means.

Figure 3:
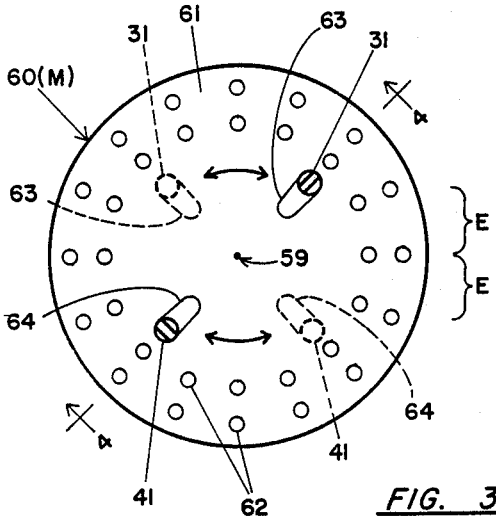
FIG. 3 is a sectional elevational view taken along line 3—3 of FIG. 1.
Figure 4:
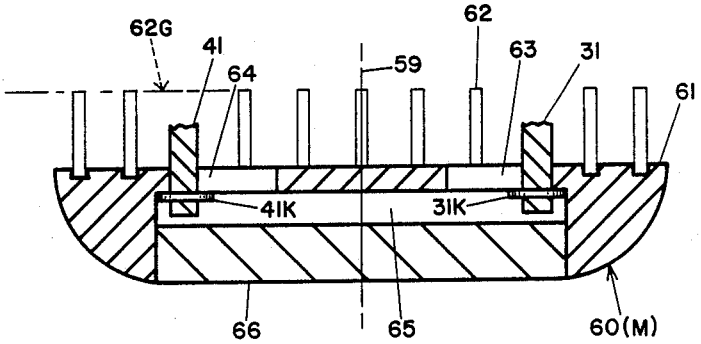
FIG. 4 is a sectional view taken along line 4—4 of FIG. 3.

In drawing FIG. 3, solid lines for crankshafts 31 and 41 and for the brush slotted portions indicate the FIG. 2 strokearm positions, while phantom lines for elements 31, 41, 63, and 64, indicate the FIG. 2A strokearm positions. Also in FIG. 3, the two double-headed curved arrows indicate that the two brushes 60(M) and 60(N) move together between FIGS. 2 and 2A conditions at angular reciprocations of substantially 75° to 105°, and preferably of about 90°.

Figure 5:
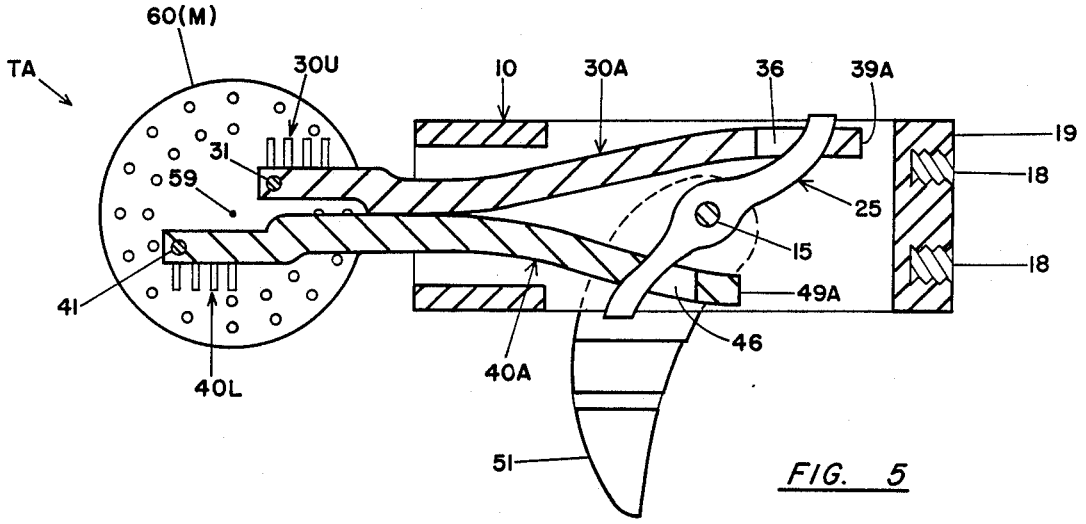
FIG. 5 is a longitudinally extending sectional elevational view similar to FIG. 2 but of an alternate toothbrush embodiment "TA"

A comparison of analagous drawing FIGS. 2 and 5 reveals that the FIG. 5 alternate embodiment "TA" differs from embodiment "T" in the following respects:

(i) the embodiment "TA" strokearms 30A and 40A have shapes differing slightly from those of embodiment "T". Moreover, forwardly adjacent their rearward ends (39A, 49A), the respective strokearms 30A and 40A are provided with openings 36 and 46, respectively; racks 37 and 47 of strokearms 30 and 40 are eliminated; and (ii) the embodiment "TA" contra-directional coordinator comprises a dual-fingers rocker member 25 having respective fingers extending through openings 36 and 46; rocker member 25 corevolvably surrounds barrel-pin 15.

Accordingly, as a powering means (e.g. 50) causes barrel-pin 15 and rocker member 25 to angularly reciprocate, strokearms 30A and 40A longitudinally reciprocate and cause brushes 60(M) and 60(N) to angularly reciprocate in synchronization with rocker member 25. By virtue of threaded apertures 18, which are engageable with said screws 79, embodiments "T" or "TA" can be readily replaced with another such unit.

From the foregoing, the construction and operation of the twin-brushes rotary toothbrush concept will be readily understood and further explanation is believed to be unnecessary. However, since numerous modifications and changes will readily occur to those skilled in the art, it is not desired to limit the invention to the exact constructions shown and described, and accordingly, all suitable modifications and changes be resorted to, falling within the scope of the appended claims.

I claim:

1. An improved twin-brushes rotary toothbrush comprising:

(A) a horizontally and directionally longitudinally extending hollow barrel having a fore-end and a rear-end, and also having directionally longitudinally extending topside and bottomside;

(B) a contra-directional coordinator located within said barrel, a central portion of said coordinator being pivotably attached to said barrel along a horizontal and directionally transversely extending barrel-pivot;

(C) a pair of substantially parallel, directionally longitudinally extending, and vertically offset horizontal strokearms including an upper-strokearm and a lower-strokearm, respective strokearms having a forward-portion located forwardly remote from the barrel fore-end, respective strokearms having a rearward-portion actuatably connected to said coordinator on vertically opposite sides of the barrel-pivot whereby as said coordinator is pivoted in alternating angular directions about said barrel-pivot, the strokearms simultaneously longitudinally reciprocate and respectively move in opposite longitudinal directions; and (D) a pair of directionally transversely separated rotary brushes flanking the strokearms forward-portions and there respectively surrounding a transverse-axis, each of said brushes comprising an upright leadward-side provided with an elliptical upper-slot located above said transverse-axis and also with an elliptical lower-slot located below said transverse-axis, and each of said brushes also comprising directionally transversely extending bristles arrayed to substantially surround said transverse-axis, the upper-strokearm being provided with transversely extending crankshafts extending into and being journalled by said elliptical upper-slots, and the lower-strokearm being provided with transversely extending crankshafts extending into and being journalled by said elliptical lower-slots whereby as said contradirectional coordinator is pivoted in alternating angular directions and the respective strokearms reciprocate in opposite longitudinal directions, the said crankshafts bear directionally longitudinally against said brushes slotted portions and the brushes are caused to move in alternating angular directional synchronization with the coordinator, and there being means for maintaining a fixed transverse spacing between said brushes.

2. The rotary toothbrush of claim 1 wherein the hollow barrel at its rear-end is removably attachable to an upright and manually graspable handle member.

3. The rotary toothbrush of claim 1 wherein there are powering means adapted to simultaneously effect alternating angular directional pivoting of said coordinator about said barrel-pivot and also opposite longitudinal directional movements of said strokearms.

4. The rotary toothbrush of claim 1 wherein rearward-portions of the strokearms have a multi-teeth rack configuration; and wherein the contra-directional coordinator comprises a pinion surrounding said barrel-pivot and actuatably connected to the multi-teeth rack portions of the strokearms.

5. The rotary toothbrush of claim 1 wherein the contra-directional coordinator comprises a rocker member extending above and below the barrel-pivot and is pivotably associated with rearward-portions of the strokearms.

6. The rotary toothbrush of claim 1 wherein the upper-strokearm forward-portion carries upwardly extending brist les and the lower-strokearm forward-portion carries downwardly extending bristles.

7. The rotary toothbrush of claim 6 wherein there are powering means adapted to simultaneously effect alternating angular directional pivoting of said coordinator about said barrel-pivot and also opposite longitudinal directional movements of said strokearms.

8. The rotary toothbrush of claim 7 wherein the barrel-pivot comprises a transversely extending barrel-pin; and wherein the powering means comprises a trigger flanking the barrel and affirmatively attached to said barrel-pin, said trigger extending below the barrel bottomside and locatable forwardly of a manually graspable handle member that depends from the barrel rear-end.

9. The rotary toothbrush of claim 8 wherein the hollow barrel at its rear-end is removably attached to an upper portion of said handle member.

10. The rotary toothbrush of claim 1 wherein the two elliptically slotted portions of each brush are located at similar distances above and below said transverse-axis whereby the crankshafts remain at constant elevations with respect to said transverse-axis as the strokearms longitudinally reciprocate.

11. The rotary toothbrush of claim 10 wherein the means for maintaining a fixed transverse spacing between the brushes comprises affirmatively connecting the crankshafts to the brushes whereby an inter-brushes connecting axle along said transverse-axis is unnecessary 12. The rotary toothbrush of claim 11 wherein an axle member extends along said transverse-axis and connects the two brushes and thereby offers optional durability to the rotary toothbrush.

13. The rotary toothbrush of claim 10 wherein the means for maintaining a fixed transverse spacing between the brushes comprises an axle member extending along said transverse-axis and connecting the two brushes forwardly remote of the barrel fore-end whereby it is unnecessary to affirmatively connect the crankshafts to the brushes.

14. An improved twin-brushes rotary toothbrush comprising:

(A) a horizontal and directionally longitudinally extending hollow barrel having a fore-end and a rear-end, and also having longitudinally extending topside and bottomside;

(B) directionally longitudinally extending and longitudinally reciprocatable strokearm means located within and connected to said barrel, said strokearm means comprising a pair of strokearms and respectively including a forward-portion always located forwardly of the barrel; and (C) a pair of rotary brushes respectively circularly surrounding a transverse-axis, said brushes being located wholly forwardly of the barrel and flanking the strokearm means forward-portion, each strokearm of the strokearm means at the forward-portion thereof carrying directionally transversely extending crankshafts being journalled by elliptically slotted portions of said brushes, said elliptically slotted portions being radially offset from said transverse-axis, and there being means for maintaining a fixed transverse spacing between the two brushes.

15. The rotary toothbrush of claim 14 wherein there are powering means for longitudinally reciprocating the strokearm means; and wherein each of said brushes comprises an array of bristles surrounding said transverse-axis and extending inwardly toward the strokearm means forward-portion.

16. The rotary toothbrush of claim 15 wherein the barrel rear-end is removably attached to an upper portion of an upright handle member.

* * * * *